United States Patent [19]

Gonzales

[11] Patent Number: 4,515,372

[45] Date of Patent: May 7, 1985

[54] GAME DEVICE

[76] Inventor: Jose M. G. Gonzales, 8520 Summer, Albuquerque, N. Mex. 87112

[21] Appl. No.: 448,231

[22] Filed: Dec. 9, 1982

[51] Int. Cl.[3] ..... A63F 3/00

[52] U.S. Cl. ..... 273/274; 273/141 R; 273/147; 273/148 R; 273/285

[58] Field of Search ..... 273/147, 148 R, 274, 273/282, 285, 141 R

[56] References Cited

U.S. PATENT DOCUMENTS

| | | | |
|---|---|---|---|
| 76,572 | 4/1868 | Wight | 273/147 |
| 1,161,552 | 11/1915 | Sickles | 273/147 X |
| 1,458,798 | 6/1923 | Bethke | 273/141 R |
| 1,538,967 | 5/1925 | Boardman | 273/141 R |
| 1,780,547 | 11/1980 | Alland | 273/147 |
| 2,002,166 | 5/1935 | Bandes | 273/148 A |
| 2,322,564 | 6/1943 | Buckley | 273/141 R |
| 2,495,007 | 1/1950 | Howard | 273/282 X |
| 3,761,091 | 9/1973 | Zohn | 273/274 |
| 4,277,067 | 7/1981 | Gettleman | 273/285 X |

FOREIGN PATENT DOCUMENTS

| | | | |
|---|---|---|---|
| 551268 | 1/1923 | France | 273/274 |
| 1318822 | 1/1963 | France | 273/148 R |
| 949733 | 2/1964 | United Kingdom | 273/274 |

*Primary Examiner*—Harland S. Skogquist
*Attorney, Agent, or Firm*—Harvey B. Jacobson

[57] ABSTRACT

A game device which consists of a game board having structural features and indicia associated with draw cards, simulated money, a pair of standard dice and a spinner which may be in the form of an octagonal spinner similar to a spinning top or an arrow type spinner provided with a support assembly associated with the game board. The upper surface of the game board includes four compartments or pockets for receiving cards and play money with each of the compartments including a lifting assembly to elevate one end of the cards or money positioned in the compartments. The game board also includes a pocket or compartment for the dice, a pocket or compartment for the top type spinner and a central circular compartment for receiving and supporting the arrow type spinner and its support assembly with the circular compartment being radially segmented and having a roughened bottom surface and being color coded in the same manner as the octagonal sides of the spinning top and provided with corresponding indicia so that the top type spinner or the arrow type spinner may be associated with the indicia in the circular compartment.

8 Claims, 9 Drawing Figures

GAME DEVICE

BACKGROUND OF THE INVENTION

1. Field of the Invention

The present invention generally relates to a game device and more particularly a game device utilizing chance control devices associated with a game board with the game board and chance control devices having associated structural relationships and associated indicia by which a unique and interesting game may be played by utilizing simulated money.

2. Description of the Prior Art

Various prior patents exist in which game boards and chance devices are associated with indicia in order to play games in accordance with particular rules of play. Exemplary of the prior art in this field of endeavor are the following U.S. patents: U.S. Pat. No. 76,572, 4/7/1868; No. 1,024,194, 4/23/12; No. 1,161,552, 11/23/15; No. 1,525,944, 2/10/25.

SUMMARY OF THE INVENTION

An object of the present invention is to provide a game device including a game board, draw cards, simulated money and chance devices including a pair of standard dice and a spinner which may be optionally a top type spinner or an arrow type spinner.

Another object of the invention is to provide a game device in which the game board has compartments on the upper surface thereof receiving the cards and simulated money with each compartment including a lift device to elevate one end of the cards or money to facilitate access thereto and handling thereof.

A further object of the invention is to provide a game device in accordance with the preceding objects in which the game board also includes a centrally located, circular compartment or pocket having a roughened bottom surface divided into a plurality of radially extending segments having distinguishable colors and indicia associated therewith.

Still another object of the present invention is to provide a game device in accordance with the preceding objects in which the game board is also provided with a pocket or compartment for receiving the dice during storage and a compartment or pocket for receiving the top type spinner and the central pocket or compartment to receive the arrow type spinner and its support assembly.

A still further object of the invention is to provide a game device in accordance with the preceding objects in which the game board is foldable along a center line with the hinge axis being at the top surface of the game board when unfolded with a partition being removably positioned in the central compartment to form a closure for the edge of the game board when folded so that articles stored in the central compartment will be retained.

Still another important object of the invention is to provide a game device in accordance with the preceding objects in which the unique apparatus is relatively simple in construction, easy to use, effective in playing various types of games and provides educational and entertainment benefits to those using the game device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
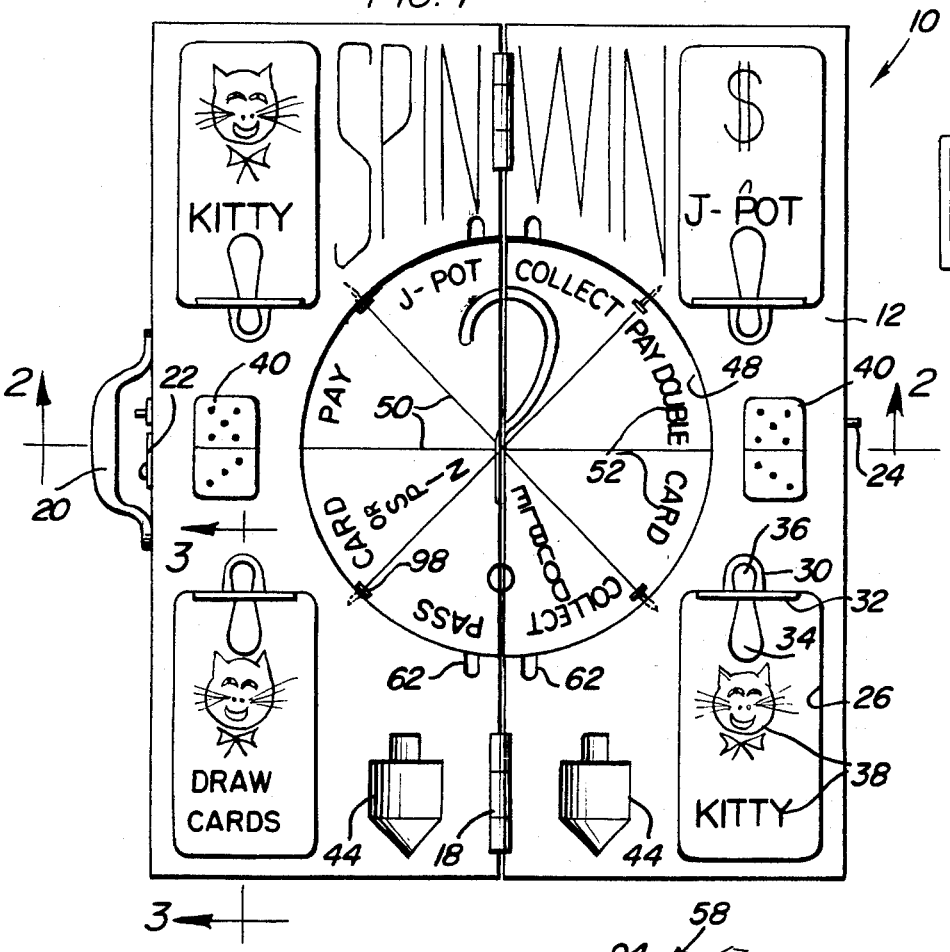
FIG. 1 is a plan view of the game board of the present invention with all of the separate components of the game device removed.
Figure 5:
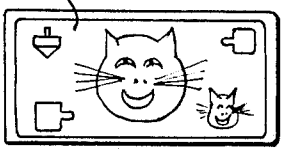
FIG. 5 is a plan view of simulated money forming part of the game device.
Figure 2:
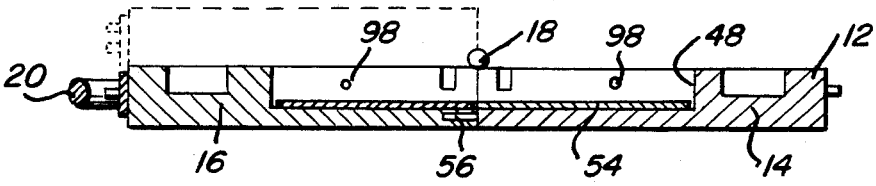
FIG. 2 is a transverse, sectional view taken substantially upon the plane passing along section line 2—2 on FIG. 1 illustrating further structural details of the game board.

Referring now specifically to the drawings, the game board constituting a part of the game device of the present invention is generally designated by the numeral 10 and includes a generally rectangular panel 12 which may be constructed of wood, plastic or any other desired material having substantial thickness as illustrated in FIG. 2 and provided with a generally planar upper and lower surface. The panel 12 is divided into two panel segments 14 and 16 joined together by a pair of hinges 18 at the upper edge of the panel segments 14 and 16 as illustrated in FIG. 2 so that when the panel segments 14 and 16 are hinged into overlying relation, the hinges 18 will be visible along the spine edge of the hinged segments 14 and 16. The edge of the panel segment 16 opposite to the hinged edge is provided with a handle 20 and a pivotal latch member 22 engageable with a pin type keeper 24 on the opposite free edge of the panel segment 14 in order to secure the panel segments 14 and 16 in overlying relation so that the game board is in a folded or closed position. When the game board is open or unfolded, it can lie flat on a supporting surface or the like with the upper surface facing upwardly as illustrated in FIG. 1.

Figure 3:
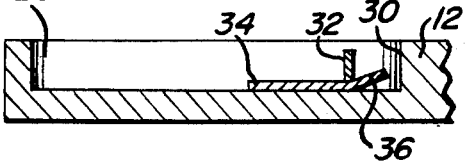
FIG. 3 is a fragmental sectional view taken substantially upon a plane passing along section line 3—3 on FIG. 1 illustrating the structural details of one of the compartments with the card lift structure illustrated.

The upper surface of the panel 12 is provided with four compartments 26 oriented generally at the corners of the panel 12 for receiving simulated money 28 or draw cards (not shown). The inner edge of each compartment 26 is provided with a recess 30 of the same depth as the compartment 26 with a vertical retaining plate 32 extending across the recess and slightly spaced upwardly from the bottom of the compartment 26 for retaining a pivotal lift plate 34 thereunder with the lift plate extending under any cards or money placed in the compartment 26. The lift plate 34 includes an upwardly angulated finger engaging tab 36 disposed in the recess 30 as illustrated in FIG. 3 so that when downward force is exerted on the tab 36, the lift plate 34 will pivot upwardly with the angulated juncture area between the tab 36 and the lift plate 34 being disposed under the retaining plate 32 so that the fulcrum axis will be under the retaining plate 32. The lift plate 34 will be in the position illustrated in FIG. 3 under normal conditions but downward force on the tab 36 will pivot the lift plate 34 upwardly thus lifting any cards or play money in the compartment 26 upwardly to enable easier access thereto. Also, each compartment 26 is provided with indicia 38 designating the material to be placed in the compartments, that is, either draw cards or simulated money.

Also, the panel 12 is provided with rectangular pockets 40 adjacent the center of each side edge thereof for receiving a pair of conventional dice 42 having a standard arrangement of pips thereon with the dice 42 being partially received in each of the compartments 40 when the game board is closed.

Figure 4:
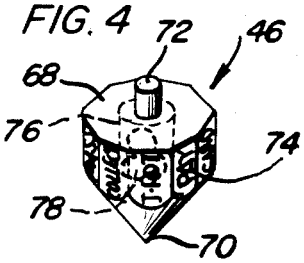
FIG. 4 is a perspective view of the top type spinner.

The panel 12 is also provided with a pair of pockets 44 adjacent one of the hinges 18 as illustrated in FIG. 1 for receiving a spinning top type spinner generally designated by numeral 46 and illustrated in FIG. 4 so that when the panel segments 14 and 16 are in overlying relation, a portion of the spinner 46 will be received in each of the compartments 44.

The central portion of the panel 12 is provided with an enlarged circular compartment 48 which is divided into a plurality of radial segments by radial division lines 50 with each pie-shaped segment being distinguishably colored in a matter described hereinafter and provided with indicia 52. The surface of the compartment 48 may be roughened and provided with a paper liner 54 or the surface may be painted or otherwise provided with the desired distinguishable colored areas and indicia.

Figure 6:
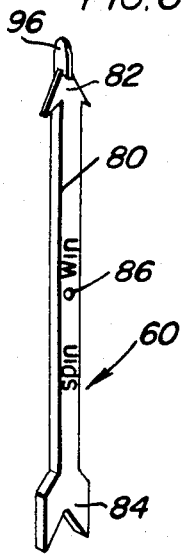
FIG. 6 is a perspective view of the arrow type spinner.
Figure 9:
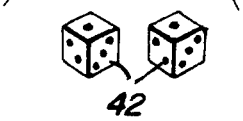
FIG. 9 is a perspective view of a pair of dice.
Figure 7:
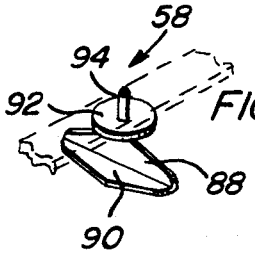
FIG. 7 is a perspective view of the support assembly for the arrow type spinner.
Figure 8:
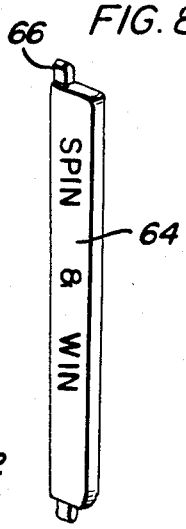
FIG. 8 is a perspective view of the insertable partition member for the central circular compartment to form a closure for this compartment when the game board is closed.

The inner edge of the panel segment 16 is provided with an arcuate groove 56 intermediate the bottom surface and the compartment 48 for supportingly engaging a support assembly 58 as illustrated in FIG. 7 for an arrow type spinner 60 as illustrated in FIG. 6. Also, the panel 12 is provided with aligned notches 62 adjacent the edge of each of the panel segment 14 and 16 to receive a partition panel 64 which has reduced end portions 66 which are reduced in height and also in width on one surface thereof as illustrated in FIG. 8. The partition 64 has an external surface which aligns with the spine edge of the hinge panel segments 14 and 16 when they are in closed position so that the partition 64 forms a closure for the compartment 48 when the two halves of the compartment 48 overlie each other thereby retaining the arrow spinner 60 and its support assembly 58 in the compartment 48 and otherwise forming a closure for this edge of the game board when closed so that the game board can be carried by the handle without danger of any of the components being lost from the opposite edge of the game board.

The top type spinner 46 includes an octagonal body 68 having a tapered and pointed lower end 70 and a projecting peg 72 at its upper end to provide a handle for spinning the spinner 46. The eight flat sides of the body 68 have indicia 74 corresponding with the indicia 52 and are colored in a manner corresponding to the distinguishable colors in the eight pie shaped areas in the central compartment 48. The center of the body 68 is hollow as designated by numeral 76 and includes a ball or other movable weight 78 therein which serves the purpose of eliminating the capability of the spinner being spun for a long period of time since the movable weight 78 will cause somewhat of an erratic movement and cause the spinner 46 to fall over in a relatively short period of time after being spun.

As indicated, the top type spinner 46 is optional with the arrow type spinner 60 which includes an elongated shank 80 having a pointed end 82 at one end and a notch 84 at the other end and a central aperture 86 with the arrow type spinner 60 being painted any suitable color. The support assembly 58 for the arrow type spinner includes a vertical plate 88 which extends downwardly between the adjacent edge surfaces of the panel segments 14 and 16 and a laterally extending arcuately curved plate 90 which is perpendicular to the vertical plate 88 with the plate 90 being received in the groove 56. The plate 88 includes a horizontally disposed disc or washer 92 with an upwardly projecting pin 94 thereon for insertion into the aperture 86 in the arrow shaft or shank 80 so that the arrow spinner 60 can be manually rotated in overlying relation to the indicia in the compartment 48 so that the pointed end 82 of the arrow 60 may designate the indicia 52. The pointed end of the arrow 82 may have a flexible tip 96 which will engage projections such as the head of a nail or tack 98 in the side wall of the compartment 48 with these projections being at the separating lines 50 to facilitate the arrow 60 coming to rest with the pointed end 82 in association with one of the colored spaces and with the indicia thereon.

The upper surface of the panel 12 may be provided with indicia designating the name or trademark associated with the game device and the simulated money 28 may be provided with various indicia on the front and rear thereof and the draw cards also may have similar indicia and indicia designating actions to be taken by the players when they draw a card. The number of draw cards may vary and the dollar value of the simulated money may vary with the object of the game being to win an opponent's money or have the most money at the end of play, such as after a predetermined time period or whenever the money in the compartments has been depleted.

Play may begin with each player receiving a predetermined quantity of simulated money and each player would ante a predetermined dollar value in the "Jackpot" compartment and each of the "Kitty" compartments and the order of play is determined by the roll of the dice 42 with play proceeding in a clockwise direction from one player to another. Each player spins and does what is indicated by the spinner. If the spinner comes up "Pay" or "Pay double", player would then roll dice to determine the amount to be paid with this money going into the "Jackpot". If a player rolls a double with a dice, the money amount paid will be doubled on "Pay" and quadrupled on "Pay double". All rolls of dice and spins of the spinner have to remain in the circular compartment 48 on the game board. If a player spins and comes up "Jackpot", he would claim all money in the "Jackpot" compartment and remaining players would re-ante to establish a new "Jackpot". Any player not able to ante into the "Jackpot" would be out of the game. If a player spins and comes up "Card", player draws a card from the card pile and follows instruction on the card. If the card reads "Pay" or any variation thereof, amount paid would go into the "Kitty". If a player can't complete card instructions, he would be out of the game. If a player spins and comes up "Card or Spin", he would follow these instructions. On the "Collect" positions on the spinner, the amount collected would be determined by the roll of dice. If a double is rolled, amount collected would be doubled. If spin is "Collect Double" and roll of dice is double, amount collected would be quadrupled and all money collected is withdrawn from the "Kitty". If a player spins and comes up "Pass", play would go to the next player in line. When only two players are left, game may be ended with a "Showdown" so that the first player to spin "Jackpot" would get all money remaining on the board. The player with the most money at the end of the game would be the winner.

While the above rules are exemplary of a game played with the invention, the rules may be varied and the indicia may be varied with the multiple chance arrangement introducing various odds and entertainment qualities to the game device. The structure of the game device enables it to be compactly stored and provides a unique arrangement of components for providing optional use of spinner arrangements.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game device comprising a game board having a generally planar upper surface, a centrally disposed, generally circular recess in the planar upper surface defining a compartment with the bottom surface of the compartment being divided into a plurality of radial segments by radial dividing lines with the radial segments being distinguishably colored and provided with indicia and chance control means movably supported in relation to the compartment for designating one of the radial segments of the bottom surface of the compartment, said chance control means including a top type spinner having a tapered lower end and a plurality of flat peripheral surfaces with the number of flat peripheral surfaces corresponding to the number of radial segments formed in the bottom surface of the compartment, the flat surfaces on the spinner including distinguishable colors and indicia corresponding with the colors and indicia on the bottom surface of the compartment, the periphery of the compartment defining a barrier for retaining the spinner therein when it is rotated and spun upon the tapered lower end, said upper surface of the game board also including a plurality of compartments located adjacent the periphery thereof for receiving simulated money or cards having instructional indicia associated therewith, each of said compartments including a lift device for elevating one end of the cards or simulated money placed in the compartments to facilitate access thereto, a pair of standard dice rollable in the compartment for indicating the results of the chance control means, said upper surface of the game board including compartment means receiving the dice for storage, said game board being foldable along a center line and provided with substantial thickness with the hinge axis being at the upper surface of the game board and above the bottom of the compartment whereby the compartment will have an open area when the game board is folded, and a partition forming a closure for the compartment when the game board is folded, said partition including projecting ends having one surface offset inwardly, said compartment having recesses in the periphery thereof along a line parallel to and adjacent the hinge axis for receiving the offset projecting ends for detachably mounting the partition across the compartment with one surface thereof aligned with the hinge axis to form a closure for the compartment when the game board is folded.

2. The structure as defined in claim 1 wherein said spinner includes a hollow central portion with a movable weight therein to render the spinner unstable to reduce the length of time the spinner will spin.

3. The structure as defined in claim 2 wherein said lift device comprising a lateral recess in each of the compartments, a lift plate disposed in the bottom of each compartment and including an upwardly angled tab oriented in the recess with the juncture between the tab and the lift plate forming a fulcrum point in engagement with the bottom of the compartment, retaining means overlying the juncture between the lift plate and upwardly angled tab to retain the lift plate in place with downward force exerted on the tab causing the lift plate to be pivoted upwardly thereby lifting the money or cards in the compartment upwardly for easy access thereto.

4. A game device comprising a game board having a generally planar upper surface, a centrally disposed, generally circular recess in the planar upper surface defining a compartment with the bottom surface of the compartment being divided into a plurality of radial segments by radial dividing lines with the radial segments being distinguishably colored and provided with indicia and chance control means movably supported in relation to the compartment for designating one of the radial segments of the bottom surface of the compartment, said chance control means including an arrow shaped spinner, means rotatably and detachably supporting the arrow shaped spinner from the central portion of the bottom surface of the compartment for associating the arrow shaped spinner with the radial segments in the bottom surface of the compartment, said arrow shaped spinner including a flexible tip end, the periphery of the compartment including projections engageable by the flexible tip end to assure that the tip end of the arrow shaped spinner will become associated with one of the segments rather than with one of the dividing lines between the segments, said means supporting the arrow shaped spinner including an upwardly projecting pin received in a centrally disposed aperture in the arrow shaped spinner, and a depending plate engaged with the game board, said game board being foldable about a center line with the hinge axis being at the upper surface of the game board, said plate extending between abutting surfaces of the game board below the hinge axis and being held in place by the abutting surfaces when the game board is unfolded, said plate including a lateral extension at the lower end thereof, one abutting edge of the abutting edges of the game board including a groove receiving the laterally extending lower end of the plate thereby anchoring the plate and supporting pin for the arrow shaped spinner in place, the upper surface of said game board also including a plurality of compartments located adjacent the periphery thereof for receiving simulated money or cards having instructional indicia associated therewith, each of said compartments including a lift device for elevating one end of the cards or simulated money placed in the compartments to facilitate access thereto.

5. The structure as defined in claim 4 together with a pair of standard dice rollable in the compartment for indicating the results of the chance control means, said upper surface of the game board including compartment means receiving the dice for storage.

6. The structure as defined in claim 5 wherein said game board is foldable along a center line and provided with substantial thickness with the hinge axis being at the upper surface of the game board and above the bottom of the compartment whereby the compartment will have an open area when the game board is folded, and a partition forming a closure for the compartment when the game board is folded, said partition including projecting ends having one surface offset inwardly, said compartment having recesses in the periphery thereof along a line parallel to and adjacent the hinge axis for receiving the offset projecting ends for detachably mounting the partition across the compartment with one surface thereof aligned with the hinge axis to form a closure for the compartment when the game board is folded.

7. The structure as defined in claim 6 wherein said lift device comprising a lateral recess in each of the compartments, a lift plate disposed in the bottom of each compartment and including an upwardly angled tab oriented in the recess with the juncture between the tab and the lift plate forming a fulcrum point in engagement with the bottom of the compartment, retaining means overlying the juncture between the lift plate and upwardly angled tab to retain the lift plate in place with downward force exerted on the tab causing the lift plate to be pivoted upwardly thereby lifting the money or cards in the compartment upwardly for easy access thereto.

8. The structure as defined in claim 6 wherein said chance control means optionally includes a top type spinner having a tapered lower end and an upwardly extending centrally located pin on the upper surface thereof to enable the spinner to be grasped and spun, said top type spinner including a body having a plurality of flat peripheral surfaces thereon with the number of flat peripheral surfaces corresponding to the number of radial segments formed in the bottom surface of the compartment, the flat surfaces on the top type spinner including distinguishable colors and indicia corresponding with the colors and indicia on the bottom surface of the compartment.

* * * * *